US006055898A

United States Patent [19]

Rinninger

[11] Patent Number: 6,055,898

[45] Date of Patent: May 2, 2000

[54] DIAPHRAGM FOR A DIAPHRAGM PUMP

[75] Inventor: Gerhard Rinninger, Pforzen, Germany

[73] Assignee: ASF Thomas Industries GmbH, Germany

[21] Appl. No.: 09/194,703

[22] PCT Filed: Jul. 11, 1997

[86] PCT No.: PCT/EP97/03698

§ 371 Date: Dec. 18, 1998

§ 102(e) Date: Dec. 18, 1998

[87] PCT Pub. No.: WO98/02661

PCT Pub. Date: Jan. 22, 1998

[30] Foreign Application Priority Data

Jul. 11, 1996 [DE] Germany ..... 296 12 117 U

[51] Int. Cl.[7] ..... F01B 19/02; F16J 3/02

[52] U.S. Cl. ..... 92/99

[58] Field of Search ..... 92/98 R, 99, 100

[56] References Cited

U.S. PATENT DOCUMENTS

| | | | |
|---|---|---|---|
| 2,267,280 | 12/1941 | Kuhnel | 92/99 |
| 5,145,336 | 9/1992 | Becker et al. | 92/99 |
| 5,699,717 | 12/1997 | Riedlinger | 92/98 R |

FOREIGN PATENT DOCUMENTS

| | | |
|---|---|---|
| 40 07 932 A1 | 9/1991 | Germany . |
| 94 10 116 | 9/1994 | Germany . |
| 94 06 216 | 11/1994 | Germany . |
| 251212 | 10/1947 | Switzerland . |

OTHER PUBLICATIONS (1983)"Les membranes: savior les choisir", Energie Fluide, vol. 22, pp.26–34.

*Primary Examiner*—F. Daniel Lopez
*Attorney, Agent, or Firm*—Scully, Scott, Murphy & Presser

[57] ABSTRACT

A diaphragm (1) for a diaphragm pump consists of a resilient material having a substantially annular outer region of a relatively low thickness and an adjacent central region which becomes thicker radially towards the center. A solid molded core (3) is vulcanized in the central region, for connection with a pump drive part. An outer diameter (F) of the core is less than a third of the outer diameter (D) of the diaphragm, and the thickness (L) of the resilient material of the central region above the solid core is between 5% and 20% of the outer diameter of the diaphragm. The diaphragm is used to avoid undesirable deformation of the diaphragm, during a tilt transmitted from the drive to the solid core, on both sides of top dead center. This diaphragm produces a pump with a low clearance volume and a large compression ratio.

6 Claims, 1 Drawing Sheet

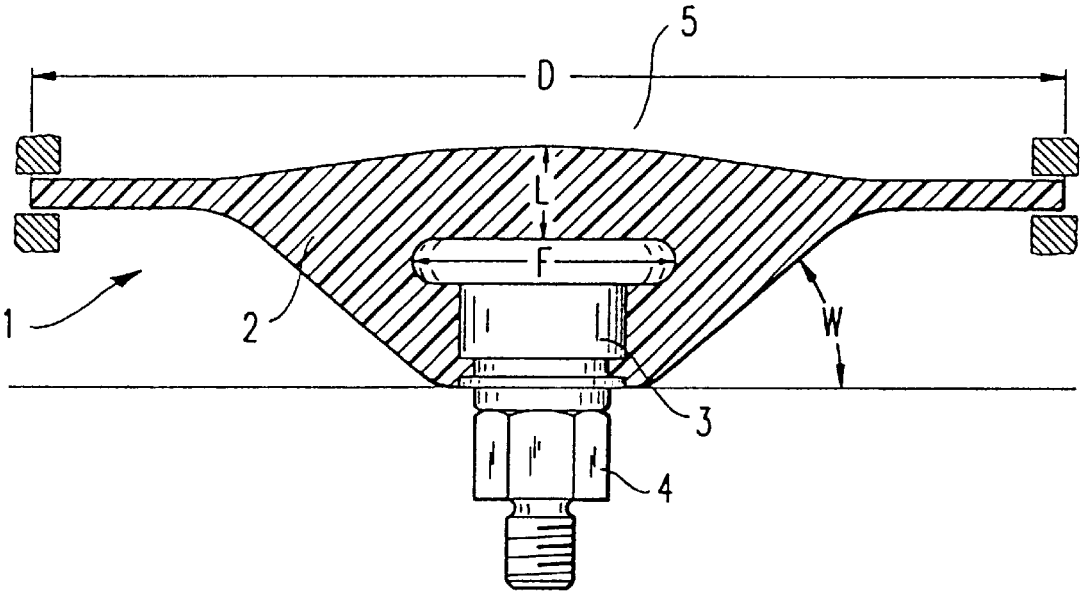
5
D
L
F
1
2
W
3
4

DIAPHRAGM FOR A DIAPHRAGM PUMP

The invention relates to a membrane for a membrane pump which has a membrane body of elastic material which is mounted at its periphery and has a rigid form core vulcanised into the membrane body, which core is connected with the pump drive part.

Such membranes are employed in membrane pumps for transporting liquids and gases, but can also be employed as vacuum pumps.

The membrane of the membrane pump is mounted at its periphery between pump head and crank case and closes downwardly the pump chamber located above the membrane. The membrane is connected, at its lower end away from the pump chamber, with a drive part which brings about an up and down movement of the membrane. The membrane fixedly mounted at its periphery elastically deforms due to the up and down movement and thus alternately makes larger and smaller the pump chamber.

Such a membrane pump is for example described in Utility Model DE G 94 10 116 U1.

For pumps of greater power and for vacuum pumps, the compression ratio, i.e. the ratio of maximum to minimum pump chamber volume, is of substantial significance. The compression ratio is determined in particular by the minium achievable pump chamber volume, i.e. by how well the elastic membrane can close off the pump chamber in the uppermost position of the membrane. With the connecting rod drive normally employed for the drive of the membrane, there occurs, shortly below top dead centre (TDC) in the upwards and in the downwards movement in each case a tilting movement of the drive rod and thus of the membrane. The tilting of the membrane causes an elastic asymmetrical deformation of the upper surface of the membrane which determines the minimum volume of the pump chamber and thus the maximum compression ratio of the pump. In other words, the rigid form core connected with the drive rod tilts shortly below top dead centre so that the membrane upper surface, in this tilt position, projects further into the pump chamber in zones to both sides of top dead centre further than at top dead centre itself. Thus, the upper pump chamber wall must exhibit a greater spacing from the membrane upper surface, whereby the minimum volume of the pump chamber and thus the compression ratio reduces.

The object of the invention is thus to propose a membrane for a membrane pump which makes possible a smaller minimum pump volume and thus a higher compression ratio of the membrane pump.

So that the stroke movement transferred to the membrane by means of the drive rod does not lead to an undesired deformation of the membrane but rather to the attainment of a stroke volume as large as possible, the rigid form core of the membrane in accordance with the invention has an outer diameter which is less than one third of the outer diameter of the membrane body. Further, the central region of the membrane body is formed with such a thickness (i.e. between 7.5% and 20% of the diameter of the membrane) that despite the elastic material it ensures a sufficient stiffness of the membrane even outside the rigid form core.

The membrane body may be advantageously of elastomeric material, in particular of ethylene-propylene-terpolymer (EPDM).

In accordance with a particularly advantageous development of the membrane in accordance with the invention, the material thickness of the membrane material, above the rigid form body, is between 7.5% and 10% of the diameter of the membrane.

The angle of the truncated cone shaped middle region of the elastic membrane body, tapering downwardly, to the radial plane perpendicular to the direction of movement of the drive, is preferably 35° to 45°. The truncated cone shaped central region of the membrane body advantageously contributes to the stiffness of the membrane.

A preferred exemplary embodiment of the membrane in accordance with the invention is described with reference to the accompanying drawing, in which the single FIGURE shows in cross-section an exemplary embodiment of the membrane in accordance with the invention.

The membrane 1 is of an elastic membrane body 2 of elastomeric material, in particular ethylene-propylene-terpolymer (EPDM) which is mounted peripherally between pump head and crank case (not shown), and has a rigid form core 3, for example of metal, which is vulcanised into the membrane. There is arranged on the form core 3 a thread 4 or the like for connection with the pump drive linkage. The membrane body 2 consists of an outer flexing region of lesser thickness and a central truncated cone shaped region into which the rigid form core 3 is vulcanised. The angle of the cone shaped section to the horizontal is advantageously 35° to 45°. This angle makes possible, despite a small outer diameter F of the form core 3, a sufficient firmness of the membrane.

So that the tilting movements transmitted to the form core 3 by means of the drive linkage (not shown) do not lead to an undesired deformation of the upper surface of the membrane towards the pump chamber 5, the rigid form core 3 has an outer diameter F which is less than one third of the outer diameter D of the membrane 1. Further, the region of the membrane body 2 lying in the central region above the rigid form core 3 has a material thickness L which is between 5% and 20%, preferably between 7.5% and 10% of the outer diameter D of the membrane. Since the relatively thick elastic part above the form core and particularly also the central cone shaped region of the membrane body outside the rigid form core 3 can deform elastically, it is possible to set a very small spacing of the membrane upper surface from the pump chamber wall at top dead centre, although before and after top dead centre the elastic cone shaped region outside the form core 3 comes into contact with the pump chamber wall through the tilting movement of the form core 3 connected with the drive linkage, since the contacting regions of the membrane can elastically spring back. Thus, the upper wall of the pump chamber 5 can be so formed that at top dead centre of the membrane only a very slight dead volume of the pump chamber remains and thus a large compression ratio is made possible for the pump driven with the membrane in accordance with the invention.

What is claimed is:

1. Membrane (1) for a membrane pump, having a membrane body (2) of elastic material, of a substantially annular outer region of lesser thickness which is mounted at its periphery, and, adjoining thereto radially towards the centre, a central region which becomes thicker, and a rigid form core (3) vulcanised into the central region of the membrane body (2), for connection with a pump drive part, a) the outer diameter (F) of the formed core (3) being less than one third of the outer diameter (D) of the membrane body (2), b) the material thickness (L) of the membrane body (2) in the central region above the formed core (3) being between 7.5% and 20% of the outer diameter (D) of the membrane and c) the central region of the membrane body (2) being, on a side away from a pump chamber (5), truncated cone shaped.

2. Membrane according to claim 1, characterised in that, the membrane body is of an elastomeric material.

3. Membrane according to claim 2, characterised in that, the membrane body is of ethylene-propylene-terpolymer (EPDM).

4. Membrane according to any of claims 1 to 3, characterised in that, the material thickness (L) of the membrane body (2), in the central region above the formed core (3), is between 7.5% and 10% of the outer diameter (D) of the membrane.

5. Membrane according to claim 1, characterised in that, the truncated cone shaped central region of the membrane body (2) exhibits an angle (W) of between 35° and 45° with respect to the radial plane.

6. Membrane pump having a membrane according to claim 1.

* * * * *